United States Patent [19]

Chanteau et al.

[11] Patent Number: 4,990,869

[45] Date of Patent: Feb. 5, 1991

[54] UHF BANDPASS FILTER

[75] Inventors: Pierre Chanteau, La Haye Malherbe; Eric Da Silva, Louviers, both of France

[73] Assignee: U.S. Philips Corporation, New York, N.Y.

[21] Appl. No.: 430,743

[22] Filed: Nov. 1, 1989

[30] Foreign Application Priority Data

Nov. 4, 1988 [FR] France ..... 88 14425

[51] Int. Cl.[5] ..... H01P 1/201; H01P 1/205

[52] U.S. Cl. ..... 333/203; 333/202; 333/235

[58] Field of Search ..... 333/202, 208, 209–212, 333/227–231, 203–205, 81 R, 81 A, 235, 246

[56] References Cited

U.S. PATENT DOCUMENTS

| | | | |
|---|---|---|---|
| 3,737,816 | 6/1973 | Honicke | 333/212 |
| 4,280,113 | 7/1981 | Sekiguchi | 333/212 X |
| 4,477,785 | 10/1984 | Atia | 333/204 X |
| 4,621,245 | 11/1986 | Dobrovolny et al. | 333/202 |
| 4,740,765 | 4/1988 | Ishikawa et al. | 333/207 X |

FOREIGN PATENT DOCUMENTS

| | | | |
|---|---|---|---|
| 0114503 | 7/1983 | Japan | 333/204 |
| 0005702 | 1/1987 | Japan | 333/208 |

*Primary Examiner*—Eugene R. LaRoche
*Assistant Examiner*—Seung Ham
*Attorney, Agent, or Firm*—Michael E. Marion

[57] ABSTRACT

A UHF bandpass filter, comprising resonators, each of which is arranged in a respective cavity and which are coupled to one another via tracks etched on a printed circuit.

20 Claims, 3 Drawing Sheets

UHF BANDPASS FILTER

BACKGROUND OF THE INVENTION

The invention relates to a UHF bandpass filter, comprising an input and an output and at least two resonators, each of which is arranged in a respective cavity.

Filters of this kind are well-known and are used notably for filtering the various television channels in cable networks.

The major drawback of conventional UHF filters consists in that the coupling between resonators is adapted by hand by means of conductor wires whose correct position for obtaining the desired bandwidth and selectivity around the central frequency of each channel is difficult to find.

It is an object of the present invention to mitigate this drawback.

SUMMARY OF THE INVENTION

A bandpass filter in accordance with the invention is notably characterized in that the coupling between the input and/or the output and a resonator and between resonators themselves is realized by means of tracks formed on a printed circuit which extends through the cavity walls, which tracks are arranged so that the transmission of energy between said tracks and said resonators takes place exclusively by radiation.

Thus, because the tracks formed on a printed circuit are fixed, the couplings are obtained during manufacture have an excellent reproducibility and the manufacture no longer involves manual adjustments because the tracks of the circuit have drafted printed and hence optimized int he design office.

In a preferred embodiment, a filter is also characterized in that said cavities are formed by an assembly of molded half-shells, one of which comprises elements which are shaped so that each element constitutes the inductive element of a repective resonator, the associated capacitor being sandwiched between said element and the bottom of the other half-shell.

Thus, as a result of the use of the molding technique, all elements of the filter exhibit an excellent reproducibility for manufacture; moreover, the inductive element is economically manufactured.

It is known to provide each resonator with a variable capacitor for adjusting the central frequency of the filter, in which case it is advantageous for said inductive elements to have a tubular shape, the adjustable core of each variable capacitor being lodged in the cavity of said tubular elements, so that said adjustable core is accessible for adjustment through the tube.

It is known that the UHF waves propagate on the surface so that the temporary introduction of an adjustment tool such as a screwdriver into the cavity of the inductive element does not modify the operation of the resonator.

In order to ensure suitable electrical contact for the assembly, preferably an elastic metallic washer is provided between the elements of the resonators; any manufacturing tolerances of the two half-shells are thus compensated for and in any case a suitable contact pressure is achieved.

In a preferred embodiment, said printed circuit for coupling is made of a semi-rigid material and is sandwiches in slots formed in each half-shell, said slots being slightly offset with respect to one another in order to clamp said printed circuit mechanically and at the same time provide ground contacts between said printed circuit and said shells.

Thus, the filter does not have any soldered joints, thus reducing the costs of manufacturing and also ensuring reproducibility of quality.

In television, the UHF band comprises 45 channels which are numbered from 21 to 65 and for which selectivity standards are imposed ($1/300 < \Delta F/F < 1/30$); in order to achieve this selectivity throughout the band, it is advantageous to provide the printed circuit with several etched patterns, the circumstances otherwise remaining the same, a given etched pattern then enabling the desired coupling rate to be obtained for a series of several adjacent channels.

In teledistribution community antenna systems it is important to supply signals having a uniform level; to this end, a variable attenuator is mounted on the printed circuit in order to enable changing of the attenuation of the transmission.

This attentuator is soldered on the printed circuit but is situated in a supplementary cavity so that the selectivity of the filter is not affected.

BRIEF DESCRIPTION OF THE DRAWINGS

The invention will be described in detail hereinafter with reference to the accompanying diagrammatic drawings. Therein.

DETAILED DESCRIPTION OF A PREFERRED EMBODIMENT OF THE INVENTION

Figure 1:
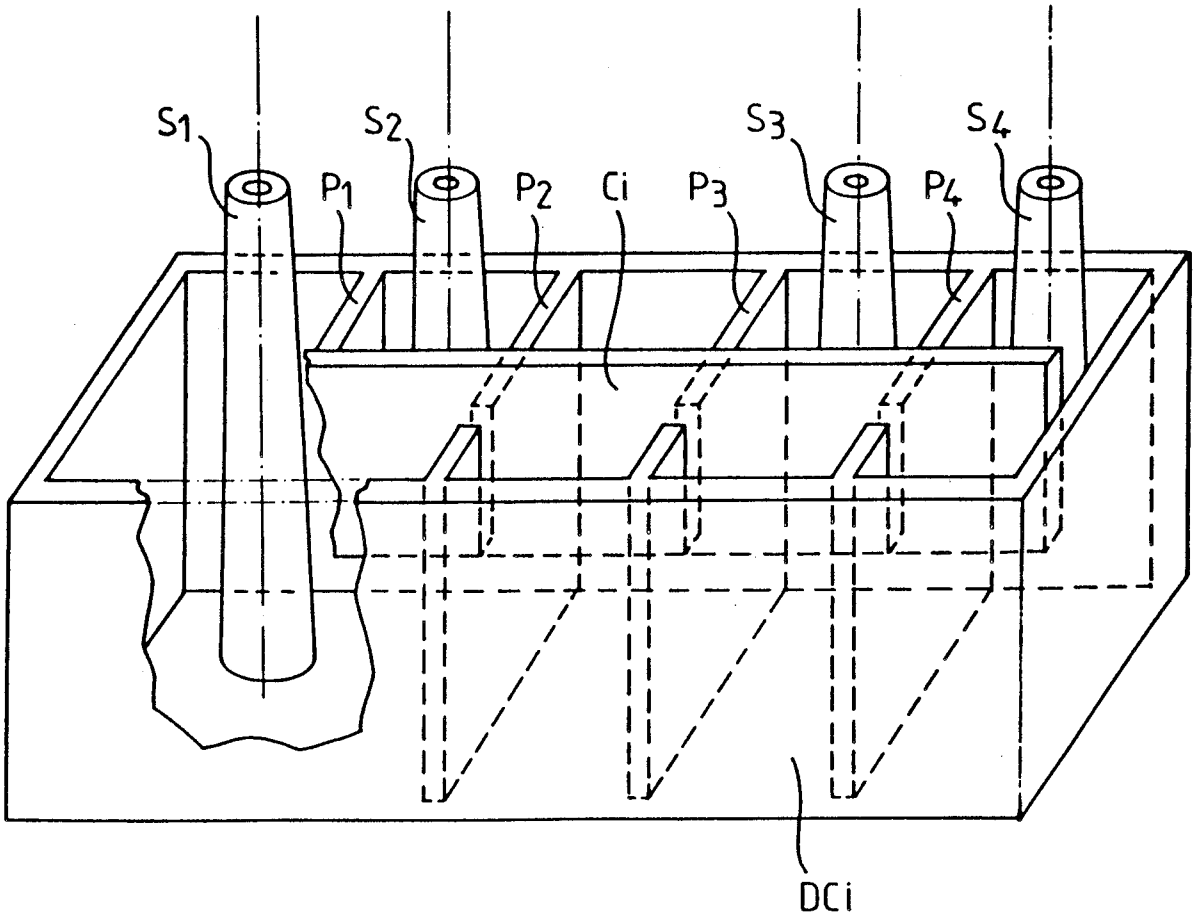
FIG. 1 is a perspective, sectional view of a half-shell.

FIG. 1 shows the lower half-shell DCi of the filter which has a generally rectangular, elongated shape and which comprises four interior partitions, P1, P2, P3, P4 which define five cavities; the extreme cavities comprise inductive elements S1, S2, S3, S4 which are in this case tubular, hollow, rough casts, for example of ZAMACK but this is not a necessity; similar shapes would also be convenient, and also a surface-metallized plastics molding. The interior partitions are provided with slots for accommodating the printed circuit CI comprising the coupling tracks.

Figure 2B:
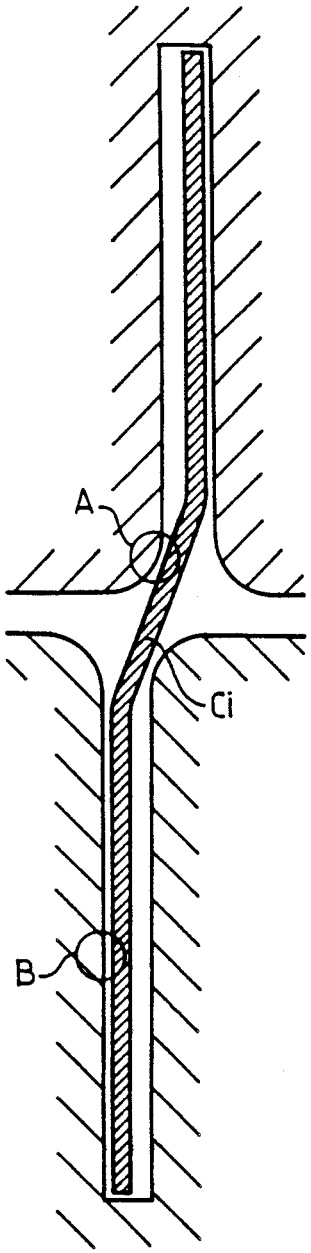
FIGS. 2*a* and 2*b* are a detailed sectional view of the filter.
Figure 2A:
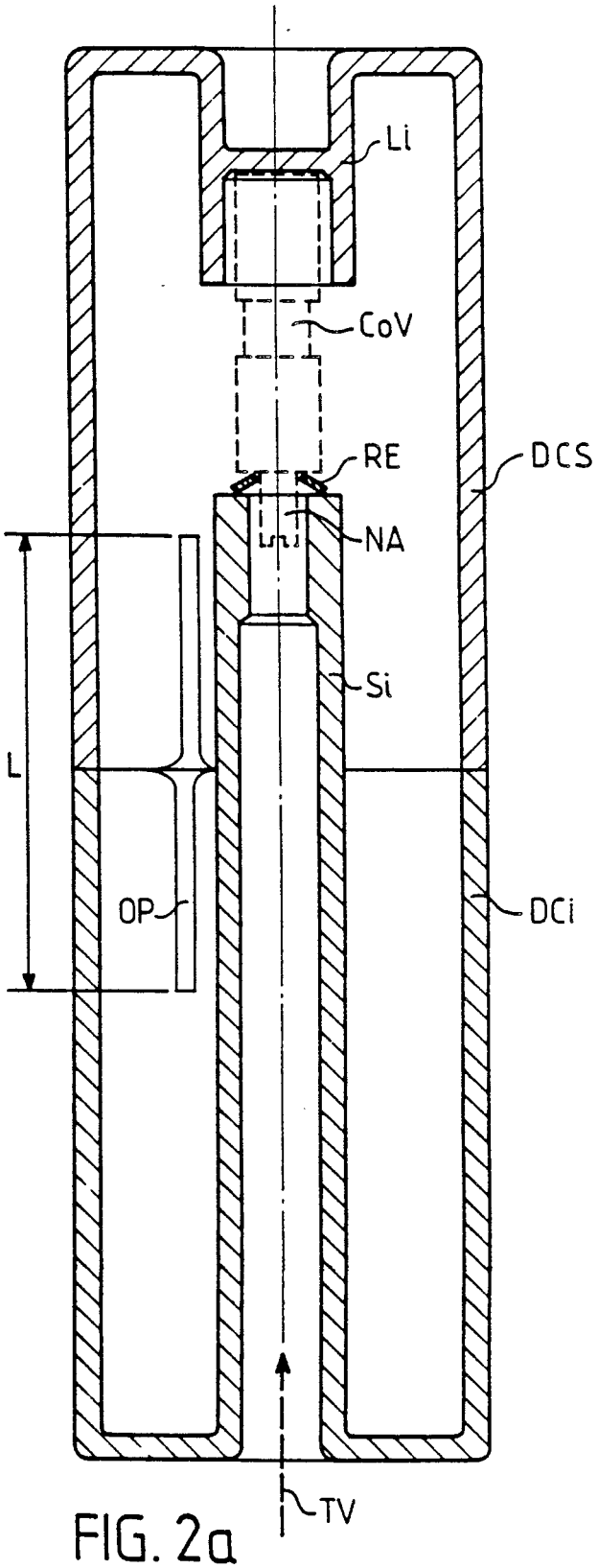

The filter casing also comprises an upper half-shell DCS, the assembly being shown in a sectional view in FIG. 2*a*. The casing DCS, DCi is cut tot the right of one of the inductive elements Si which faces a seat Li. The elements Li and Si are designed for locating, during mounting, a variable capacitor CoV (denoted by broken lines in the Figure) whose adjustable core NA is situated in the cavity of the inductive element and is thus accessible to a screwdriver type adjustment tool in the direction of the arrow TV. In order to compensate for manufacturing tolerances and to ensure suitable electrical contact, an elastic metallic washer RE is provided, for example of the type ONDUFLEX. The upper half-shell comprises four partitions facing the partitions P1, P2, P3, P4; they are also provided with slots for forming a passage OP for the printed circuit. In FIG. 2*b* the passage OP is shown at a larger scale in order to illustrate that the slots are slightly offset so that the printed circuit Ci is clearly deformed and clamped by the half-shells during mounting; thus, electrical contact can be obtained, for example at the points A and B, between the casing and the copper tracks to the right of the partitions. For example, the external diameter of the inductive element is 6 mm and its height is 50 mm, each half-shell having a height of 35 mm, so a height of 70 mm for the filter whose width amounts to 20 mm and whose length amount to 90 mm. The central cavity is provided for accommodating the commonly used attenuator which is in this case soldered onto the printed circuit.

Each inductive element Si with its associated capacitor CoV forms a variable oscillatory circuit; because the HF currents propagate according to the skin effect, i.e, on the external surface of each inductive element in the present case, the temporary introduction of the screwdriver type adjustment tool TV into the tube does not modify the operation of the oscillatory circuit.

Figure 3:
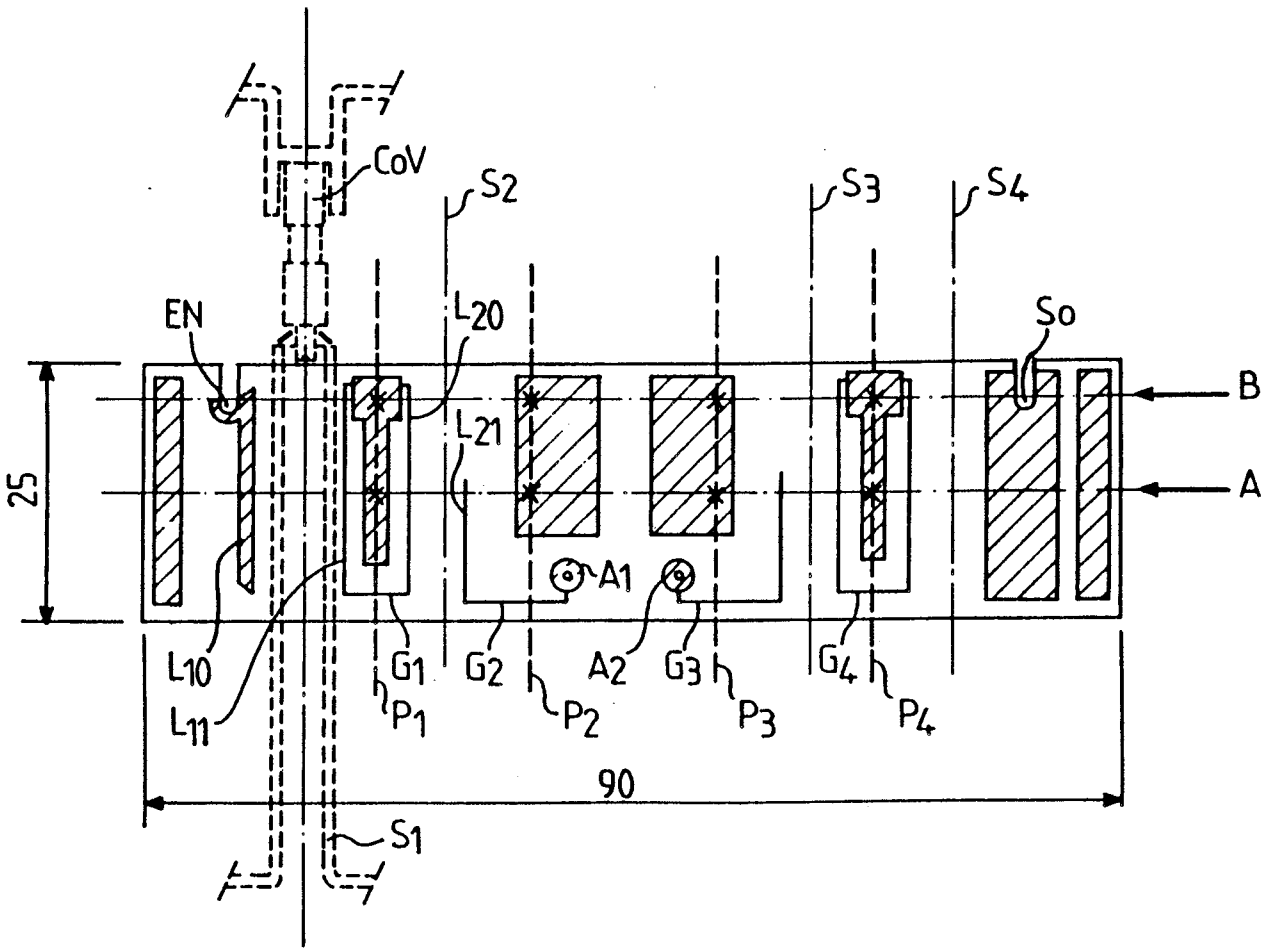
FIG. 3 shows a printed circuit.

An example of an etching pattern is shown in FIG. 3; the copper tracks are represented therein either as a non-interrupted line or as a shaded area.

Each circuit has the same external dimension, for example 25×90 and is made of a semi-rigid material for elastically supporting the above deformation, only the copper tracks being different from one pattern to another.

In FIG. 3 the axes of passage of the inductive elements S1, S2, S3, S4 and the partitions P1, P2, ', ∝ are vertically shown; in the horizontal direction the axes of the possible contacts A and B with the casing to the right of the partitions are also indicated so that, on each circuit a copper track is connected to ground if it is situated at the intersection of the axis A or B with the axes P1, P2, P3 and P4; these points are denoted by crosses "X".

For a suitable illustration of the positioning and proportioning of the elements of the filter, the inductive element S1 and its associated capacitor CoV are denoted by broken lines.

The input signal to be filtered arrives at the input point EN and, via the track L10, it excites the inductive element S1 which responds by way of its capacitance CoV and in its turn excites the track L11; the transmission of energy in this case takes place exclusively by radiation; the signal collected by L11 is conductively transmitted by the conductor G1 which traverses the partition P1 to the track L20; the inductive element S2 is excited by the signal present on L20 and in its turn excites the track L21; the transmission of energy between S2 and L21 again takes place exclusively by radiation; the signal is then transmitted by the conductor G2 which traverses the partition P2, reaching an attenuator which is connected between the terminals A1 and A2; the signal is then transmitted by the conductor G3, etc. and ultimately reaches, after passage through the partitions P3, P4 and the inductive elements S3 and S4, the output terminal SO where the filtered signal is available.

It is to be noted that the point of high overvoltage of each resonator, that is to say the point where the washer RE is situated, is in contact only with air and excludes any dielectric, which is of primary importance for preserving the best possible overvoltage coefficient.

We claim:

1. A bandpass filter having an input and an output and at least two resonators, each of which is disposed within respective cavities, said filter comprising:

(a) an assembly comprising two molded half shells forming said cavities and at least one cavity wall, a first half shell being formed into a plurality of inductive elements;

(b) a printed circuit board coupled to said input, said output and at lest one of said resonators and extending between at least two of said cavities;

wherein each of said resonators is formed by a respective inductive element and a capacitor disposed between said respective inductive element and a second half shell.

2. A bandpass filter as claimed in claim 1 wherein energy is transmitted between said printed circuit and said resonators exclusively by radiation.

3. A bandpass filter as claimed in claim 1, wherein each capacitor is a variable capacitor having an adjustable core for adjusting the central frequency of said filter and wherein each inductive element has a tubular shape, said adjustable core of each variable capacitor being disposed within the tubular shape of respective inductive elements.

4. A bandpass filter as claimed in claim 2, wherein each capacitor is a variable capacitor having an adjustable core for adjusting the central frequency of said filter and wherein each inductive element has a tubular shape, said adjustable core of each variable capacitor being disposed within the tubular shape of respective inductive elements.

5. A bandpass filter as claimed in claim 1, wherein said printed circuit is made of a semi-rigid material and is disposed in slots formed in said first and second half shells, said slots being slightly offset with respect to one another in order to mechanically hold said printed circuit in position and to provide ground contact between said printed circuit and said assembly.

6. A bandpass filter as claimed in claim 2, wherein said printed circuit is made of a semi-rigid material and is disposed in slots formed in said first and second half shells, said slots being slightly offset with respect to one another in order to mechanically hold said printed circuit in position and to provide ground contact between said printed circuit and said assembly.

7. A bandpass filter as claimed in claim 3, wherein said printed circuit is made of a semi-rigid material and is disposed in slots formed in said first and second half shells, said slots being slightly offset with respect to one another in order to mechanically hold said printed circuit in position and to provide ground contact between said printed circuit and said assembly.

8. A bandpass filter as claimed in claim 1, for filtering UHF channels 21–65 and for which the ratio of a passband to the central frequency is between 1/30 and 1/300, and wherein a pattern of tracks etched on said printed circuit enables uniform coupling to be obtained for several adjacent channels.

9. A bandpass filter as claimed in claim 2, for filtering UHF channels 21-65 and for which the ratio of a passband to the central frequency is between 1/30 and 1/300, and wherein a pattern of tracks etched on said printed circuit enables uniform coupling to be obtained for several adjacent channels.

10. A bandpass filter as claimed in claim 3, for filtering UHF channels 21–65 and for which the ratio of a passband to the central frequency is between 1/30 and 1/300, and wherein a pattern of tracks etched on said printed circuit enables uniform coupling to be obtained for several adjacent channels.

11. A bandpass filter as claimed in claim 4, for filtering UHF channels 21–65 and for which the ratio of a passband to the central frequency is between 1/30 and 1/300, and wherein a pattern of tracks etched on said printed circuit enables uniform coupling to be obtained for several adjacent channels.

12. A bandpass filter as claimed in claim 5, for filtering UHF channels 21–65 and for which the ratio of a passband to the central frequency is between 1/30 and 1/300, and wherein a pattern of tracks etched on said printed circuit enables uniform coupling to be obtained for several adjacent channels.

13. A bandpass filter as claimed in claim 6, for filtering UHF channels 21–65 and for which the ratio of a passband to the central frequency is between 1/30 and 1/300, and wherein a pattern of tracks etched on said printed circuit enables uniform coupling to be obtained for several adjacent channels.

14. A bandpass filter as claimed in claim 7, for filtering UHF channels 21–65 and for which the ratio of a passband to the central frequency is between 1/30 and 1/300, and wherein a pattern of tracks etched on said printed circuit enables uniform coupling to be obtained for several adjacent channels.

15. A filter as claimed in claim 1, further comprising a variable attenuator mounted on said printed circuit.

16. A filter as claimed in claim 2, further comprising a variable attenuator mounted on said printed circuit.

17. A filter as claimed in claim 3, further comprising a variable attenuator mounted on said printed circuit.

18. A filter as claimed in claim 4, further comprising a variable attenuator mounted on said printed circuit.

19. A filter as claimed in claim 5, further comprising a variable attenuator mounted on said printed circuit.

20. A filter as claimed in claim 14, further comprising a variable attenuator mounted on said printed circuit.

* * * * *